US008168903B2

(12) United States Patent
Chen

(10) Patent No.: US 8,168,903 B2
(45) Date of Patent: May 1, 2012

(54) ILLUMINATED KEYBOARD

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 216 days.

(21) Appl. No.: 12/718,677

(22) Filed: Mar. 5, 2010

(65) Prior Publication Data

US 2011/0147180 A1 Jun. 23, 2011

(30) Foreign Application Priority Data

Dec. 18, 2009 (TW) ..... 98143539 A

(51) Int. Cl.
*H01H 9/00* (2006.01)

(52) U.S. Cl. ..... 200/310

(58) Field of Classification Search ..... 200/310–314, 200/5 A, 512, 517, 344–345; 362/555, 558, 362/559, 616, 26, 27
See application file for complete search history.

(56) References Cited

U.S. PATENT DOCUMENTS

| | | | | |
|---|---|---|---|---|
| 6,036,326 | A * | 3/2000 | Yoshikawa et al. | 362/23 |
| 7,847,204 | B2 * | 12/2010 | Tsai | 200/314 |
| 2001/0040802 | A1 * | 11/2001 | Shipman | 362/227 |
| 2006/0283698 | A1 * | 12/2006 | Huang et al. | 200/310 |

* cited by examiner

*Primary Examiner* — Edwin A. Leon
(74) *Attorney, Agent, or Firm* — Kirton McConkie; Evan R. Witt

(57) ABSTRACT

An illuminated keyboard includes a frame plate, a character keycap, a light source, a membrane plate, a switch circuit plate and a base plate. The character keycap is connected with the frame plate, and movable upwardly or downwardly with respect to the frame plate. The light source is disposed under the character keycap for emitting invisible light. The character keycap, the frame plate, the membrane plate, the switch circuit plate and the base plate are sequentially arranged from top to bottom. The illuminated keyboard further includes a luminous substance, which is excited by the light source to generate visible light to irradiate the illuminated keyboard.

16 Claims, 3 Drawing Sheets

ILLUMINATED KEYBOARD

FIELD OF THE INVENTION

The present invention relates to an input device of an electronic apparatus, and more particularly to a thin type illuminated keyboard for use with an electronic apparatus such as a computer.

BACKGROUND OF THE INVENTION

A conventional computer keyboard has no self-illuminating function. Generally, a dim environment becomes hindrance from operating the keyboard. Recently, an illuminated keyboard has been developed. When the illuminated keyboard is used in the dim environment, the user can accurately depress desired keys by means of the light scattered from peripheries of the keys or middle portions of the keys. In addition, the light produced by the illuminated keyboard results in an aesthetically pleasing appearance. For example, Chinese Patent Application No. CN200820125924.4 disclosed an illuminated keyboard. The illuminated keyboard sequentially comprises a character keycap, a connecting member, a light-transmissible base plate, a light-guiding plate, a light emitting diode, and a reflector. The character keycap and the light-transmissible base plate are connected with each other through the connecting member. As such, the character keycap is movable with respect to the light-transmissible base plate in the vertical direction. The light emitting diode is disposed on the reflector, and accommodated within a receptacle of the light-guiding plate. Through the reflector and the light-guiding plate, the light emitted by the light emitting diode is guided to the region under the character keycap so as the illuminate the whole illuminated keyboard.

Since the conventional illuminated keyboard needs an additional light-guiding plate and associated keyboard component to guide light, the cost of guiding light is high. Moreover, when the conventional illuminated keyboard is used in a dim environment, a serious light leakage problem occurs and the illuminated keyboard becomes less identifiable.

SUMMARY OF THE INVENTION

It is an object of the present invention to provide an illuminated keyboard for reducing the light-guiding cost and minimizing the light leakage problem.

In accordance with an aspect of the present invention, there is provided an illuminated keyboard. The illuminated keyboard comprises a frame plate, a character keycap, a light source, a membrane plate, a switch circuit plate and a base plate. The character keycap is connected with the frame plate, and movable upwardly or downwardly with respect to the frame plate. The light source is disposed under the character keycap for emitting invisible light. The character keycap, the frame plate, the membrane plate, the switch circuit plate and the base plate are sequentially arranged from top to bottom. The illuminated keyboard further includes a luminous substance, which is excited by the light source to generate visible light to irradiate the illuminated keyboard.

In an embodiment, the luminous substance is a fluorescent agent.

In an embodiment, the illuminated keyboard further includes an ink layer, and the luminous substance is doped in the ink layer.

In an embodiment, the ink layer is formed on a bottom surface of the frame plate at a position right under the character keycap.

In an embodiment, the ink layer is formed on a top surface of the membrane plate at a position right under the character keycap.

In an embodiment, the ink layer is formed on a top surface of the switch circuit plate at the position right under the character keycap.

In an embodiment, the membrane plate is a transparent plastic sheet.

In an embodiment, the luminous substance is doped in a material for producing the character keycap.

In an embodiment, the character keycap has a light-transmissible character portion, which is defined by coating a surface of the character keycap with an opaque material and then removing a character.

In an embodiment, the character is removed by a laser engraving process to define the light-transmissible character portion of the character keycap.

In an embodiment, the light source is a mercury vapor UV lamp.

In an embodiment, the light source is an UV light emitting diode.

In an embodiment, the frame plate has a light-guiding function. A concave structure is formed in a bottom surface of the frame plate. The concave structure is not in communication with a top surface of the membrane plate. The light source is disposed on the membrane plate and accommodated within the concave structure.

In an embodiment, the light source is fixed on the membrane plate via an electrically-conductive adhesive.

In an embodiment, the illuminated keyboard further includes a connecting member and an elastic member. The connecting member is used for connecting the character keycap with the frame plate. The elastic member is bonded onto the switch circuit plate, so that the character keycap is elastically movable upwardly and downwardly.

In an embodiment, the frame plate has a hollow portion. The elastic member is penetrated through the hollow portion. A curvy profile is formed on an inner wall of the hollow portion.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides an illuminated keyboard. The present invention will now be described more specifically with reference to the following drawings and embodiments. The illuminated keyboard of the present invention is applied to an input device of an electronic apparatus such as a laptop, a desktop computer or an industrial computer.

Figure 1:
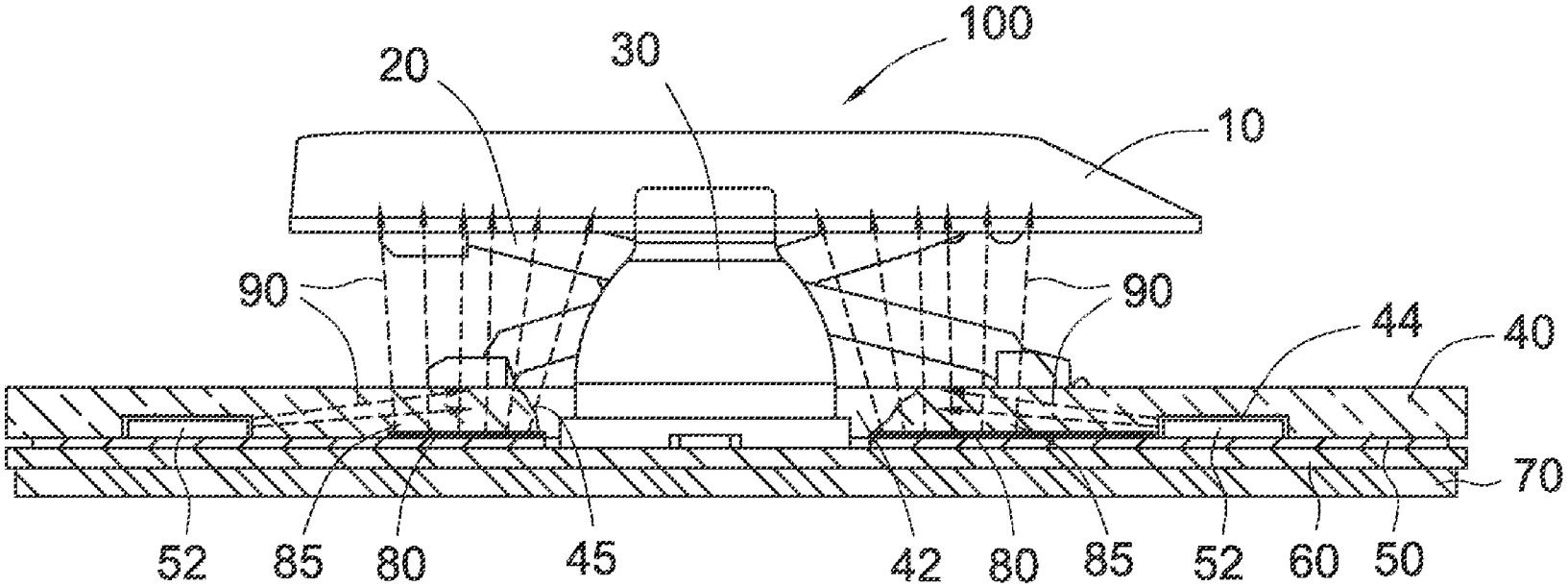
FIG. 1 is a schematic cross-sectional view illustrating a key structure of an illuminated keyboard according to a first embodiment of the present invention.

FIG. 1 is a schematic cross-sectional view illustrating a key structure of an illuminated keyboard according to a first embodiment of the present invention. As shown in FIG. 1, the illuminated keyboard 100 of the present invention comprises a character keycap 10, a connecting member 20, an elastic member 30, a light-guiding frame plate 40, a membrane plate 50 with a light source 52, a switch circuit plate 60 and a base plate 70. The character keycap 10, the frame plate 40, the membrane plate 50, the switch circuit plate 60 and the base plate 70 are arranged from top to bottom.

The character keycap 10 is light-transmissible. The connecting member 20 is a scissors-type connecting structure for connecting the character keycap 10 and the frame plate 40. As such, the character keycap 10 is movable with respect to the frame plate 40 in the direction perpendicular to the surface of the illuminated keyboard 100. The elastic member 30 is made of silicone rubber and has a shape of an inverted cup. The upper end surface of the elastic member 30 is positioned on the bottom surface of the character keycap 10. After the character keycap 10 is penetrated through the frame plate 40 and the membrane plate 50, the lower end surface of the character keycap 10 is bonded onto the switch circuit plate 60. Alternatively, the lower end surface of the character keycap 10 is not bonded onto the switch circuit plate 60, but in contact with the switch circuit plate 60. Due to the elastic member 30, the keycap 10 is elastically movable upwardly and downwardly.

The frame plate 40 has a light-guiding function. The frame plate 40 has a hollow portion 42. The elastic member 30 is penetrated through the hollow portion 42. The frame plate 40 has two lateral connecting parts, which are arranged at bilateral sides of the hollow portion 42 and connected with the connecting member 20. In addition, a concave structure 44 is formed in the bottom surface of the frame plate 40 for accommodating the light source 52. The intersection between the centerline of the character keycap 10 and the frame plate 40 is separated from the concave structure 44 by a specified spacing interval. A curvy profile or any other scraggy profile is formed on the inner wall 45 of the hollow portion 42. By the curvy profile or the scraggy profile, the direction of the light emitted by the light source 52 is changed toward the top surface of the frame plate 40 to irradiate the keycap 10

In this embodiment, the light source 52 is an UV light source for emitting invisible light in an ultraviolet spectrum. For example, the light source 52 is an UV light emitting diode or a mercury vapor UV lamp. The driving circuit (not shown) for driving the light source 52 is disposed on the membrane plate 50. The light source 52 is fixed on the membrane plate 50 via an electrically-conductive adhesive, and accommodated within the concave structure 44 of the frame plate 40. Corresponding to the hollow portion 42 of the frame plate 40, the membrane plate 50 has a hole (not shown). As such, the elastic member 30 could be penetrated through the hole. An exemplary membrane plate 50 is a light-transmissible transparent plastic sheet.

Moreover, an ink layer 80 is formed on the membrane plate 50. The ink layer 80 is doped with a luminous substance. In this embodiment, the luminous substance is an UV (ultraviolet) reflective substance, which is excited by the light source 52 to emit visible light. For example, the ink layer 80 is made of UV reflective ink. Alternatively, the ink layer 80 is made of noctilucent ink. For example, the ink layer 80 may contain a fluorescent agent, which is excited by the light source 52 to emit visible light. In a case that the ink layer 80 is made of noctilucent ink, the light source 52 is a light emitting diode for emitting invisible light in an ultraviolet spectrum, or an ordinary light emitting diode for emitting visible light. The noctilucent ink is able to absorb the UV light or visible light that is emitted by the light source 52. Once the light source 52 is turned off, the light source 52 could still emit light.

The ink layer 80 is printed on the top surface of the membrane plate 50 at the position immediately under the character keycap 10 (see FIG. 1). When the light source 52 is turned on, the light 90 is absorbed by the ink layer 80 and thus a visible light irradiates the character keycap 10 through the frame plate 40.

In some embodiments, the ink layer 80 is printed on the bottom surface of the frame plate 40 at the position immediately under the character keycap 10. Alternatively, the ink layer 80 is printed on the top surface of the switch circuit plate 60 at the position immediately under the character keycap 10.

In an embodiment, the base plate 70 is a metallic plate such as an aluminum plate or an iron plate.

By the luminous substance of the ink layer 80, the light 90 emitted by the light source 52 is converted into visible light to be projected on the character keycap 10. In other words, the visible light is localized within the irradiated region of the ink layer 80. As a consequence, the problem of causing light leakage problem is minimized, and the keys of the illuminated keyboard 100 become more identifiable. Moreover, since the light source 52 is arranged between the frame plate 40 and the membrane plate 50 and buried within the frame plate 40, the thickness of the light source 52 is sunk into the thickness of the frame plate 40. In other words, the overall thickness of the illuminated keyboard is not increased while maintaining a minimized thickness.

Figure 2:
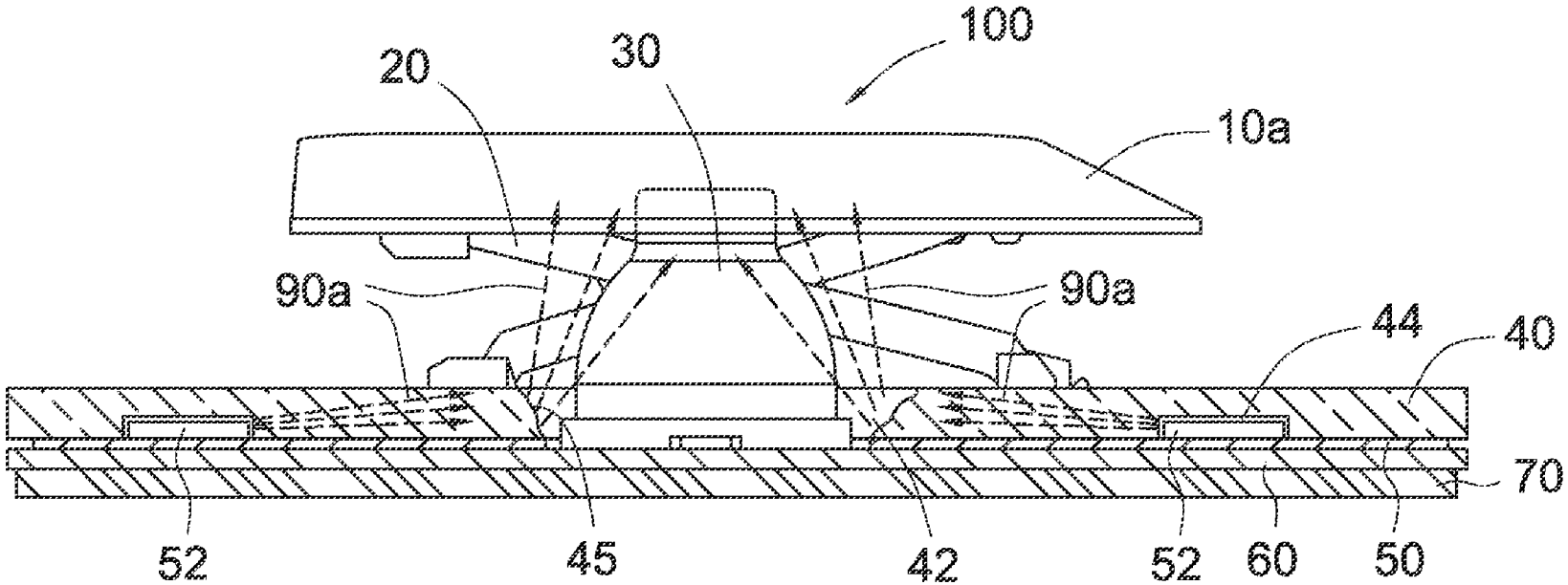
FIG. 2 is a schematic cross-sectional view illustrating a key structure of an illuminated keyboard according to a second embodiment of the present invention.
Figure 3:
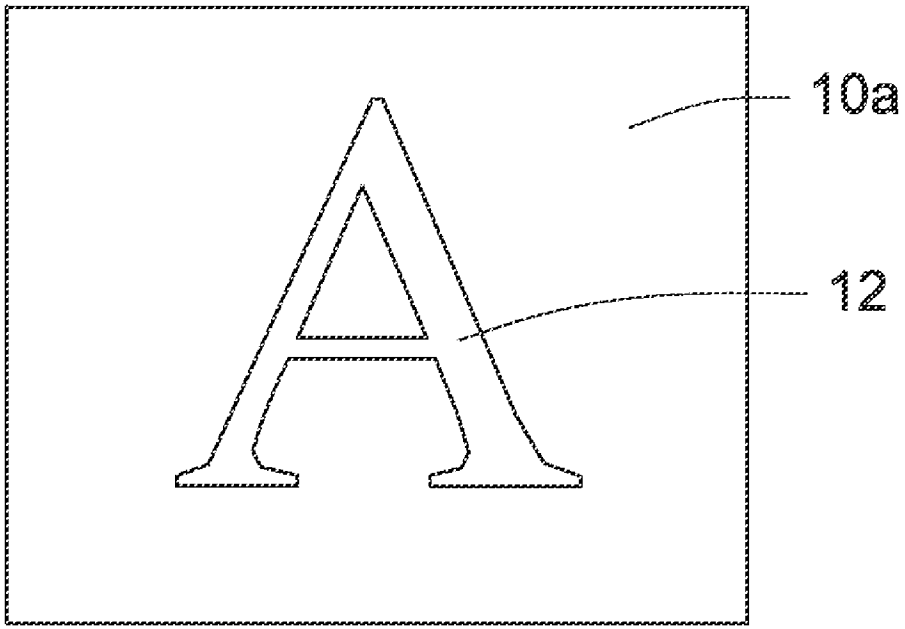
FIG. 3 is a schematic top view illustrating a character keycap of the illuminated keyboard according to the second embodiment of the present invention.

FIG. 2 is a schematic cross-sectional view illustrating a key structure of an illuminated keyboard according to a second embodiment of the present invention. FIG. 3 is a schematic top view illustrating a character keycap of the illuminated keyboard according to the second embodiment of the present invention. In comparison with the first embodiment, no ink layer 90 is included on the membrane plate 50 of the illuminated keyboard of the second embodiment. Whereas, the luminous substance (e.g. a fluorescent agent) is doped in a material for producing the character keycap 10. When the light source 52 is turned on to emit invisible light 90*a*, the invisible light 90*a* is transmitted to the region under the character keycap 10*a* through the frame plate 40 (see FIG. 2). Once the invisible light 90*a* is absorbed by the fluorescent agent of the character keycap 10*a*, the invisible light 90*a* is converted into visible light.

As shown in FIG. 3, the character keycap 10*a* has a light-transmissible character portion 12. After the surface of the character keycap 10*a* is coated with an opaque material, the character is removed by for example a laser engraving process in order to define the light-transmissible character portion 12. The general character or symbol may be printed on the character portion 12 of the character keycap 10*a*. Since only the character portion 12 of the main body of the character keycap 10*a* is light-transmissible but the non-character portion is opaque, the problem of causing light leakage problem will be largely reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard comprising:

a frame plate;

a character keycap connected with said frame plate, and movable upwardly or downwardly with respect to said frame plate;

a light source disposed under said character keycap for emitting invisible light;

a membrane plate;

a switch circuit plate; and a base plate, wherein said character keycap, said frame plate, said membrane plate, said switch circuit plate and said base plate are sequentially arranged from top to bottom, and said illuminated keyboard further comprises a luminous portion comprising a luminous substance, which is excited by said light source to generate visible light to irradiate said illuminated keyboard.

2. The illuminated keyboard according to claim 1 wherein said luminous substance is a fluorescent agent.

3. The illuminated keyboard according to claim 2 wherein said illuminated keyboard further comprises an ink layer, and said luminous substance is doped in said ink layer.

4. The illuminated keyboard according to claim 3 wherein said ink layer is formed on a bottom surface of said frame plate at a position right under said character keycap.

5. The illuminated keyboard according to claim 3 wherein said ink layer is formed on a top surface of said membrane plate at a position right under said character keycap.

6. The illuminated keyboard according to claim 3 wherein said ink layer is formed on a top surface of said switch circuit plate at the position right under said character keycap.

7. The illuminated keyboard according to claim 1 wherein said membrane plate is a transparent plastic sheet.

8. The illuminated keyboard according to claim 1 wherein said luminous substance is doped in a material for producing said character keycap.

9. The illuminated keyboard according to claim 1 wherein said character keycap has a light-transmissible character portion, which is defined by coating a surface of said character keycap with an opaque material and then removing a character.

10. The illuminated keyboard according to claim 9 wherein said character is removed by a laser engraving process to define said light-transmissible character portion of said character keycap.

11. The illuminated keyboard according to claim 1 wherein said light source is a mercury vapor UV lamp.

12. The illuminated keyboard according to claim 1 wherein said light source is an UV light emitting diode.

13. The illuminated keyboard according to claim 1 wherein said frame plate has a light-guiding function, a concave structure is formed in a bottom surface of said frame plate, said concave structure is not in communication with a top surface of said membrane plate, and said light source is disposed on said membrane plate and accommodated within said concave structure.

14. The illuminated keyboard according to claim 1 wherein said light source is fixed on said membrane plate via an electrically-conductive adhesive.

15. The illuminated keyboard according to claim 1 wherein said illuminated keyboard further comprises:

a connecting member for connecting said character keycap with said frame plate; and an elastic member bonded onto said switch circuit plate, so that said character keycap is elastically movable upwardly and downwardly.

16. The illuminated keyboard according to claim 15 wherein said frame plate has a hollow portion, said elastic member is penetrated through said hollow portion, and a curvy profile is formed on an inner wall of said hollow portion.

* * * * *